United States Patent [19]

Heinzle

[11] 4,373,457

[45] Feb. 15, 1983

[54] FEED ARRANGEMENT FOR TEXTILE MACHINES

[76] Inventor: August Heinzle, Altweg 9, A-6844 Altach, Austria

[21] Appl. No.: 122,847

[22] Filed: Feb. 20, 1980

[30] Foreign Application Priority Data

Feb. 20, 1979 [AT] Austria ..... 1304/79

[51] Int. Cl.[3] ..... D05C 3/04; D05B 49/04

[52] U.S. Cl. ..... 112/96; 112/241; 112/246; 112/248; 66/132 R; 242/55; 226/143; 226/152

[58] Field of Search ..... 112/96, 93, 79 R, 241, 112/242, 246, 248; 66/132 R; 226/123, 143, 152, 153; 242/55 R

[56] References Cited

U.S. PATENT DOCUMENTS

| | | | |
|---|---|---|---|
| 952,858 | 3/1910 | Zahn | 112/96 X |
| 2,039,236 | 4/1936 | Meisel | 226/143 X |
| 3,943,865 | 3/1976 | Short et al. | 112/79 R |

FOREIGN PATENT DOCUMENTS

| | | | |
|---|---|---|---|
| 71977 | 6/1916 | Austria | 112/96 |
| 1929310 | 6/1969 | Fed. Rep. of Germany | 112/93 |
| 91531 | 2/1922 | Switzerland | 112/96 |

*Primary Examiner*—H. Hampton Hunter

*Attorney, Agent, or Firm*—Toren, McGeady and Stanger

[57] ABSTRACT

A thread feed arrangement particularly suitable for use in an embroidery machine for feeding and tightening a thread includes a drive mechanism for rotating a thread roller in the machine about its axis so as to tighten the thread a desired amount after the thread is formed into a stitch or loop. The drive mechanism is controlled by a control device in corresponding relationship with the formation of the stitch or loop, such as by a punched card control system which controls the entire operation of the machine. When using the feed arrangement, thread breakage is significantly reduced and a substantial number of commonly used reciprocating machine parts such as thread guides are no longer required.

5 Claims, 2 Drawing Figures

FEED ARRANGEMENT FOR TEXTILE MACHINES

BACKGROUND OF THE INVENTION

The present invention relates to an arrangement for feeding and tightening one or more threads which are formed into stitches or loops in a textile machine. In particular, the arrangement includes a drive mechanism for rotatably driving a thread roller or cylinder in the machine which roller frictionally contacts the thread.

In conventional textile machines, continuously moving thread guides are provided for removing a length of thread from a supply spool at a time prior to forming the thread into a stitch or a loop. After the stitch or loop is formed, the thread guides operate to pull back on the thread, thereby tightening the stitch or loop. Such movement of the thread requires a number of reciprocating machine parts as well as so-called thread brakes, otherwise the thread would be needlessly pulled from the spool upon each movement of the thread guides. In view of the conventional thread feeding operation, up to now, the construction of textile machines has been very complicated and costly and, in addition, these machines have required a great deal of maintenance.

A thread control arrangement is known for use in shuttle embroidery machines wherein an ornamental cord is fed in a manner such that it does not loosen or sag. Ornamental cord can pucker and form small knots to a much greater extent than ordinary embroidery thread. Therefore, it is important that this cord not loosen or sag, i.e., the cord must always be subjected to a uniform and gentle stress.

It is clear, however, that in the case of embroidery threads which are used to produce an embroidered pattern wherein the threads are pulled by a needle, there are certain periods during formation of a stitch in which the thread should not be stressed. In fact, a stitch formation could not be properly carried out in an embroidery machine if the thread is stressed during the first reverse short stroke movement of the needle, since no loop would be formed through which the machine shuttle could pass. Therefore, while the known arrangement may be practically applied when using ornamental cord, it cannot be successfully implemented in the feeding and tightening of embroidery threads. Additionally, in the known arrangement, uniform reciprocating movement of a roller which carries the ornamental cord is provided for all stitches. However, the actual feeding movement of an embroidery thread depends only on the movement of the embroidery foundation, so that a tightening stress such as applied to the ornamental cord would be borne by the embroidery foundation if the known arrangement were used in an embroidery machine.

It will be understood that the length of thread required to allow for advancing movement of the embroidery frame in the machine must be made available by momentarily releasing the thread roller from frictional contact with the thread. It is therefore not possible to implement the above known control arrangement with embroidery thread, since the embroidery operation requires that the thread be released from stress at certain times during the formation of a stitch or loop.

An arrangement for stressing embroidery threads is also known, wherein a thread roller is subjected to a biasing force of a spring after each forward movement of the thread roller, which tends to cause the roller to move in a backward direction as soon as the roller is to be advanced by a tooth-like pawl. Therefore it is only possible with this arrangement to achieve a desired thread advancement wherein the thread is tightened from the embroidery foundation by way of the needle and a separate porcupine roller in the machine, since the thread roller freely rotates as the thread is advanced and only thread brakes provided in the machine counteract the thread advancement. Thus, a further disadvantage results in that tightening of the embroidery thread occurs under stress developed by a spring force, so that thread breakage and, possibly, needle breakage will occur quite often. Also, in this arrangement, only a relatively large mechanical feed movement of the thread roller can be provided because a cam plate which is mounted on a cam shaft provided for rotating the thread roller can only be moved in accordance with movement of the driving mechanism of the embroidery machine. Since, in embroidery machines, a single embroidering operation takes place for each rotation of the main shaft of the machine, the cam shaft with the cam thereon will turn once during a given embroidering operation. Therefore, even if a suitable gear arrangement were available, only a uniform feed movement would result, and the thread roller would follow the downward motion of a locking pawl, thereby hindering the pawl from engaging other teeth. Further, with this arrangement, the thread roller will always undergo substantially uniform reciprocating movement, wherein a particular amount of forward movement results upon advancing the thread. Such an arrangement is, therefore, practically impossible to implement without the use of conventional thread guides.

A thread feeding device for a multi-needle creel embroidery machine is also known, wherein a length of thread corresponding to that required for a stitch is fed for each stitch to be formed. It is, however, necessary to provide thread guides in this arrangement to allow for an additional length of thread required during formation of each stitch. Otherwise, no stitch could be formed and thereafter tightened. In this device, a relatively complicated arrangement provides for advance movement of a thread roller, which movement is derived from the creel driving shaft. It is also possible to avoid excessive stress on the thread when it is tightened. However, when applied to embroidery machines, no significant improvement results since additional complicated mechanical parts must be installed without allowing other parts to be removed. Further, a calculation of the overall length required to be fed for each stitch can not be performed, because a mechanical adjustment takes place in accordance with the creel movement so that the embroidery foundation and the threads themselves can be relieved of stress only to a relatively small degree. In any case, reverse rotation of a separate porcupine roller is not possible with this device, so that thread guides are still required to carry out stitch formation.

An object of the present invention is to provide a textile machine feed arrangement which overcomes the above disadvantages and which enables the feeding and tightening of threads to be adjusted exactly as required, and with which stitches or loops can be tightened by a desired amount.

In accordance with the present invention, a feed arrangement for feeding and tightening a thread in a textile machine of the type which includes a thread roller about which the thread is looped at least once to frictionally contact the thread roller, includes a drive mechanism for rotating the thread roller about its axis in either direction to tighten the thread a desired amount after the thread is formed into a stitch or a loop by the textile machine. The feed arrangement also includes a control device for controlling the drive mechanism in corresponding relationship with the formation of the stitch or loop.

Accordingly, with the arrangement of the present invention, all forward and reverse movements of an embroidery thread relative to the embroidery foundation can be controlled by a thread roller or cylinder. Thus, no stress is applied to the embroidery foundation as a result of tightening of the thread and, further, a number of complex machine parts may be omitted such as, for example, both large and small arm thread guides and their corresponding drive mechanisms. By use of, for example, a punched card control system, a suitable thread feed can be provided wherein an additional thread feed for stitching movement of the needle takes place immediately prior to needle puncture. After each stitch is formed, a suitable amount of thread tightening can be provided. It will be appreciated that proper thread tightening after the formation of each stitch is an essential requirement for high quality embroidered items and, of course, for all high quality textile products.

The thread roller or cylinder in the arrangement of the present invention also operates as a thread brake, so that advancing and reversing movements of the thread during tightening of the stitches or loops can occur without slippage. When using conventional reciprocating thread guides, however, tension is transferred to the thread supply spool and also to the textile products by way of the needle. Thus, the arrangement of the present invention is especially advantageous for use in the manufacture of delicate textile products or in the fabrication of very fine patterns.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
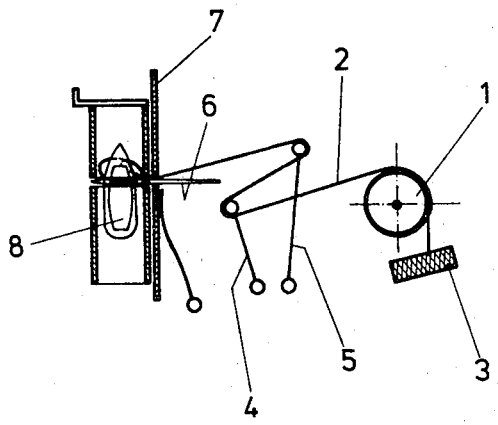
FIG. 1 is a schematic diagram of a thread feed arrangement in an embroidery machine, showing the use of conventional thread guides.

In FIG. 1, a thread roller or cylinder 1 is arranged in an embroidery machine in a conventional manner. The thread roller 1 is also known as an emery roll. A length of thread 2 being removed from a supply spool 3 travels over the thread roller 1, the thread being wound about the outer circumferential surface of the thread roller 1 one or more times in frictional contact therewith, so that the thread roller 1 can operate as a thread brake. The thread 2 then follows a path wherein it contacts one end of a small arm thread guide 4, and thereafter contacts one end of a large arm thread guide 5 before engaging a needle 6. The arms of the thread guides 4 and 5 are each pivoted at their ends opposite the thread 2, so that each of the guides 4 and 5 can be swung abouts its pivot axis. Prior to formation of a stitch, a length of the thread 2 is removed from the supply spool 3 by swinging movement of the thread guides 4 and 5, the end of the thread 2 closer to the needle 6 being fixed to an embroidery foundation 7. As a result of this swinging movement of the thread guides 4 and 5, the roller 1 is rotated about its axis by the thread 2 as the thread is removed from the supply spool 3.

Since a relatively large thread loop is required during formation of a stitch, the large thread guide 5 is swivelled in the direction toward the embroidery foundation 7 so that the thread 2 is loosened sufficiently to form a large loop through which a shuttle 8 can pass. After the stitch is formed, the large thread guide 5 is returned to the position shown in FIG. 1 so that it pulls the stitch tight. In conventional embroidery machines which include the thread guides 4 and 5, the thread roller 1 does not have an associated drive mechanism. However, a locking device is used to lock the thread roller 1 against rotational movement at certain times, if necessary. Such a locking device is used if an especially strongly tightened stitch is desired.

In accordance with the present invention, the thread roller 1 has an associated drive mechanism which, in an embroidery machine, can be controlled directly by particular moving members in the machine, or indirectly by way of a punched card control system which controls the entire machine operation.

The arrangement of the present invention is especially practical when a control system which reads punched cards by electrical or electo-mechanical means is provided, wherein control pulses are transmitted from a punched card reader to an appropriate control device. The control device operates to activate particular stepping motors, disk drivers or hydraulic motors provided for the creel drive mechanism. Since the control device determines the magnitude of adjusting movement of the embroidery creel, an appropriate thread advance can also be provided by rotating the thread roller 1 during movement of the embroidery creel, or immediately before movement of the embroidery creel, thereby resulting in a significant reduction in the occurrence of thread breakage. With the conventional thread guides, swinging movement of the thread guide 4 to pull thread off the supply spool 3 often resulted in thread breakage. Also, if the thread were too loose, it might twist which again would result in breakage.

Existing embroidery machines can be modified in accordance with the present invention, the thread 2 being guided over the thread guides 4 and 5, as before. However, the thread guides 4 and 5 are fixed against swinging movement. Feeding, tightening and pulling of the thread 2 is then carried out only by the thread roller 1, the thread 2 frictionally contacting the thread roller 1 over which it is looped one or more times. Disabling the thread guides 4 and 5 from swinging movement results not only in a reduction of the overall power required to operate the embroidery machine, but also in a significant reduction of noise since, as it is well known, pivotally reciprocating parts such as the thread guides in conventional textile machines are the major source of operating noise.

Figure 2:
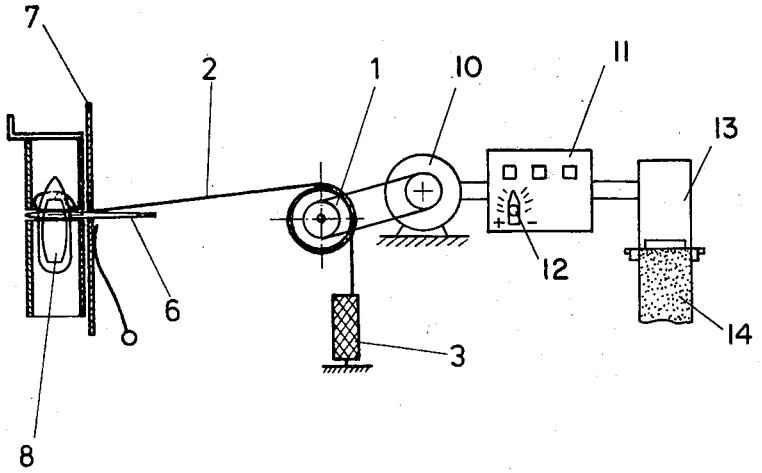
FIG. 2 is a schematic diagram, similar to FIG. 1, of a thread feed arrangement according to the present invention.

FIG. 2 shows a feed arrangement according to the present invention which can be applied particularly in new embroidery machines. The thread guides 4 and 5 of FIG. 1 are omitted in the arrangement of FIG. 2, thereby significantly increasing the space available for a needle rail in the machine. This advantage is especially significant in the design of multi-color embroidery machines. Of course, the feed arrangement of FIG. 2 can be implemented in conventional embroidery machines by removal of the thread guides provided in such machines.

In FIG. 2, the thread roller 1 is driven about its axis in either of both rotational directions by a driving mechanism 10 which can be controlled by, for example, a punched card control system for controlling the operation of the embroidery machine in which the feed arrangement of FIG. 2 is implemented. The control system may include, for example, a control device 11 having manual setting members 12, and an electromechanical reading device 13 for punched cards 14. Pulses can be derived from the control system to effect rotation of the thread roller 1 so as to advance or pull back the thread 2. During formation of a stitch (or loop), a suitable advancing movement of the thread roller 1 is provided to obtain a sufficient length of thread 2 from the supply spool 3 and, at the end of the stitch forming operation, the stitch is tightened by an appropriate reversing movement of the thread roller 1. The embroidery machine is greatly simplified since the small and large thread guides 4 and 5 are omitted. Consequently, various steering rods, thread guide driving elements and other machine parts can also be omitted. For new machines, the fact that these parts are not required is an advantage which far outweighs the requirement of an additional drive mechanism for the roller 1. The significant reduction of mechanical parts which is realized provides a substantial noise reduction. Also, thread movement can be more easily monitored, and threading is more easily accomplished. Omission of the thread guides 4 and 5 directly in front of the embroidery foundation 7 allows for special auxiliary equipment to be arranged there, if desired. The supply spool 3 may be arranged either horizontally or upright, as shown in FIGS. 1 and 2.

For multi-color embroidery machines, it is possible to arrange several thread rollers 1, for example, one above the other wherein a desired one of the rollers would be placed in operation when a corresponding thread is to be used. It is also possible to guide each thread over a separate thread roller 1 which is rotated at the appropriate time, by way of frictional engagement with a driving roller provided in the machine. When the driving roller is disengaged from a particular thread roller, the thread associated with that thread roller then remains stationary.

As discussed above, conventional embroidery machines include a locking device for locking the thread roller 1 against rotation in the event an especially tight stitch is desired. Thus, when a punched card control system is used to control machine operations, the operation of such locking device is carried out by providing an appropriate instruction from the punched cards which are read in the system. In accordance with the present invention, upon an instruction to activate the locking device, the reverse rotational movement of the thread roller 1 is increased by a certain amount so that the tightening stress applied to the thread is correspondingly increased. In this manner, the same punched cards can be used as before, wherein the control device output pulses corresponding to a "lock" instruction are transmitted to the drive mechanism for the thread roller 1, instead of to the locking device. It will therefore be appreciated that additional mechanical parts, that is, the entire locking device of the convetnional embroidery machines can be omitted.

Embroidery machines often perform a drilling operation wherein certain holes are formed by a drill in the embroidery foundation 7, and the hole borders are thereafter embroidered. Since the drills are located a certain distance below the needles, a corresponding distance of the creel must be travelled. During the drilling operation, the thread 2 must be loosely held at this time. Therefore, upon a "drilling" instruction from the punched cards, an activating pulse for the drive mechanism of the thread roller 1 can be derived and an appropriate forward or reverse rotational movement of the roller 1 can be provided before and after drilling.

The present invention also contemplates the provision of manually operated adjusting members 12 associated with the control device for the drive mechanism of the thread roller 1. These members allow for a certain increase or decrease in the amount of thread roller rotational movement instructed by the punched cards used with the control system. For example, a pulse provided by the punched card control system which corresponds to strong tightening of a stitch (activation of the locking device) can then be given an even stronger, or a weaker effect, so that additional control is possible. Moreover, during drilling or other special operations performed by the embroidery machine, advancing and reversing movements of the threads can be precisely adjusted by way of the adjusting members.

With the feed arrangement of the present invention which has been described for purposes of illustration in connection with an embroidery machine, various patterns of uniform quality can be reproduced, this feature being very important in, for example, a frotte pattern or in a moss finish. In these cases, loops of suitable lengths must remain even after the formation of stitches. This can only be accomplished if the length of thread returned after each stitch formation remains uniform and can be precisely controlled.

The feed arrangement of the present invention can be applied in all types of embroidery machines, and the particular type of punched card control system which is used is of no special importance.

Moreover, the feed arrangement of the present invention can be used in all types of textile machines which perform any kind of stitch or loop forming operation. It is therefore possible to provide, for example, a sewing machine with a suitable thread roll which feeds, tightens and pulls the thread back in accordance with operating movements of different machine members (needle, butt, etc.). In the case of sewing machines, reciprocating thread guides could then be omitted.

It is also possible to activate the drive mechanism for the thread roller or cylinder 1 by means other than a punched card control system. For example, the transport movement of the particular textile products to be manufactured or processed, such as a length of cloth or the like, can be processed to activate the thread or drive mechanism. Further, the thread roller drive mechanism can be activated in accordance with the transport or advancing movement of the needles which carry the thread or threads, or by such movement of other tools used in the stitch or loop forming operations.

Activation of the thread roller drive mechanism in accordance with a required amount of tightening after a stitch or loop is formed is possible by movement of the thread roller in one rotational direction or the other. In textile machines other than embroidery machines, manually operated adjusting members can also be provided to allow for a desired variation in the amount of tightening of stitches or loops formed by the machine.

When compared with the conventional textile machines which include a number of reciprocating thread guides, the feed arrangement of the present invention provides a significant improvement in and simplification of such machinery. A number of reciprocating, relatively heavy machine parts are omitted, and the operating speed of the machine can therefore be increased while a significant reduction of noise results. Existing textile machines can also be modified to incorporate the present feed arrangement by simply fixing reciprocating parts provided on those machines against reciprocating movement, and the significant advantages of the present invention as described above will be fully realized.

While specific embodiments of the invention have been shown and described in detail to illustrate the application of the inventive principles, it will be understood that the invention may be embodied otherwise without departing from such principles.

What is claimed is:

1. A feed arrangement for feeding and tightening a thread with respect to a foundation in a textile machine which includes a supply of thread and a generally cylindrical thread roller about which the thread is looped at least once to frictionally contact the thread roller, comprising drive means directly connected to the thread roller for rotating the thread roller in one direction about its axis to feed intermittently desired lengths of the thread from the thread supply so that successive stitches of the thread can be formed in the foundation, and for rotating the thread roller in the opposite direction about its axis after each stitch is formed to tighten the thread a desired amount relative to the foundation, and means for controlling said drive means so that different lengths of thread can be fed successively by the thread roller to form corresponding stitches in the foundation during operation of the textile machine.

2. A feed arrangement according to claim 1, wherein said controlling means comprises a control device operatively coupled to said drive means for causing said drive means to rotate the thread roller a certain amount in said opposite direction in accordance with the desired amount of tightening of the thread after formation of each stitch, and including manually operated adjusting members associated with said control device for selectively varying the amount of rotation of the thread roller relative to said certain amount.

3. A feed arrangement according to claim 2, wherein said control device comprises a punched card control system.

4. A feed arrangement according to claim 1, wherein said controlling means includes a member arranged in the textile machine for forming a stitch from the thread in accordance with movement of the member.

5. A feed arrangement according to claim 1, wherein said controlling means includes means in the textile machine for responding to movement of needles which carry the thread.

* * * * *